US008032039B2

(12) United States Patent
Nakamura

(10) Patent No.: US 8,032,039 B2
(45) Date of Patent: Oct. 4, 2011

(54) CONTROLLER, IMAGE-FORMING DEVICE, AND STORAGE MEDIUM

(75) Inventor: Hideyasu Nakamura, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 85 days.

(21) Appl. No.: 12/566,939

(22) Filed: Sep. 25, 2009

(65) Prior Publication Data

US 2010/0215383 A1 Aug. 26, 2010

(30) Foreign Application Priority Data

Feb. 25, 2009 (JP) ..... 2009-042629

(51) Int. Cl.
*G03G 15/00* (2006.01)

(52) U.S. Cl. ..... 399/38; 399/13; 399/391

(58) Field of Classification Search ..... 399/13, 399/23, 38, 51, 391, 405
See application file for complete search history.

(56) References Cited

U.S. PATENT DOCUMENTS

| | | | | |
|---|---|---|---|---|
| 5,450,159 | A * | 9/1995 | Choi et al. | 399/113 |
| 2006/0153588 | A1* | 7/2006 | Sakai et al. | 399/110 |
| 2009/0148211 | A1* | 6/2009 | Kimura | 399/391 |

FOREIGN PATENT DOCUMENTS

| | | | |
|---|---|---|---|
| JP | 04-112150 | A | 4/1992 |
| JP | 05-077938 | A | 3/1993 |
| JP | 2007-106539 | A | 4/2007 |

* cited by examiner

*Primary Examiner* — Sandra Brase
(74) *Attorney, Agent, or Firm* — Sughrue Mion, PLLC

(57) ABSTRACT

A controller includes: a detection unit that detects that a housing unit housing a recording medium has been inserted into an insertion slot for inserting the housing unit; a prediction unit that predicts a vibratory excitation time at which vibrations will occur based on a time detected by the detection unit; a determination unit that determines whether the vibrations will occur based on the vibratory excitation time during a period when an image-forming unit is forming an image on a recording medium supplied from a different supply source for recording media from the housing unit inserted into the insertion slot; and a control unit that controls the image-forming unit to prevent image formation if the determination unit determines that the vibrations will occur during a period when the image-forming unit is forming an image on the recording medium.

12 Claims, 6 Drawing Sheets

CONTROLLER, IMAGE-FORMING DEVICE, AND STORAGE MEDIUM

CROSS-REFERENCE TO RELATED APPLICATIONS

This application claims priority under 35 USC 119 from a Japanese patent application No. 2009-042629 filed on Feb. 25, 2009.

BACKGROUND

1. Technical Field

The present invention relates to a controller, an image-forming device, and a program.

2. Background

Image-forming devices include those that are for mass printing, having multiple housing units for a recording medium, e.g., units known as paper trays or paper cases. For example, such an image-forming device may include multiple insertion slots, wherein paper cases housing paper are inserted into the respective insertion slots, and paper is supplied from any of these paper cases to the image-forming device. Even if no more paper is housed in one paper case, an image-forming process can be sustained by switching the paper supply source for the image-forming engine to another paper case. For such an image-forming device, it is common to measure the amount of remaining recording medium housed in the paper case in use and to instruct a user to prepare another paper case when only a small amount of recording medium is remaining. When a user receives such an instruction, the user prepares a sufficient amount of paper, e.g., by inserting fresh paper into the insertion slot.

Meanwhile, an electrophotographic image-forming device includes an optical mechanism for the implementation of a process of reading an image from a copied manuscript and a process of forming an image on a photoreceptor as an electrostatic latent image. These optical mechanisms cannot perform their respective functions when there is variation in the positional relationship between the light source and the irradiated subject as it may lead to a disruption in the image.

However, as described above, when the user inserts another paper case, for example, accompanied by shock when a member deep inside the insertion slot and the paper case collide, the image-forming device is subjected to vibration, and the positional relationship between the light source and the irradiated subject may thus vary. Thereby, distortion and disruption may occur in the image.

SUMMARY

According to one aspect of the invention, there is provided a controller including: a detection unit that detects that a housing unit housing a recording medium has been inserted into an insertion slot for inserting the housing unit; a prediction unit that predicts a vibratory excitation time at which vibrations will occur based on a time detected by the detection unit; a determination unit that determines whether the vibrations will occur based on the vibratory excitation time during a period when an image-forming unit is forming an image on a recording medium supplied from a different supply source for recording media from the housing unit inserted into the insertion slot; and a control unit that controls the image-forming unit to prevent image formation if the determination unit determines that the vibrations will occur during a period when the image-forming unit is forming an image on the recording medium.

BRIEF DESCRIPTION OF THE DRAWING

Exemplary embodiment(s) of the present invention will be described in detail based on the following figures, wherein.

DETAILED DESCRIPTION

An exemplary embodiment according to an aspect of the invention is described as follows.

Herein, an electrophotographic printer (image-forming device) with an intermediate transfer belt and a so-called tandem engine is exemplified and described as an exemplary embodiment of the implementation of the present invention, but the present invention is not limited to this exemplary embodiment.

A. Configuration

A-1. Overall Configuration of the Image-Forming Device

Figure 1:
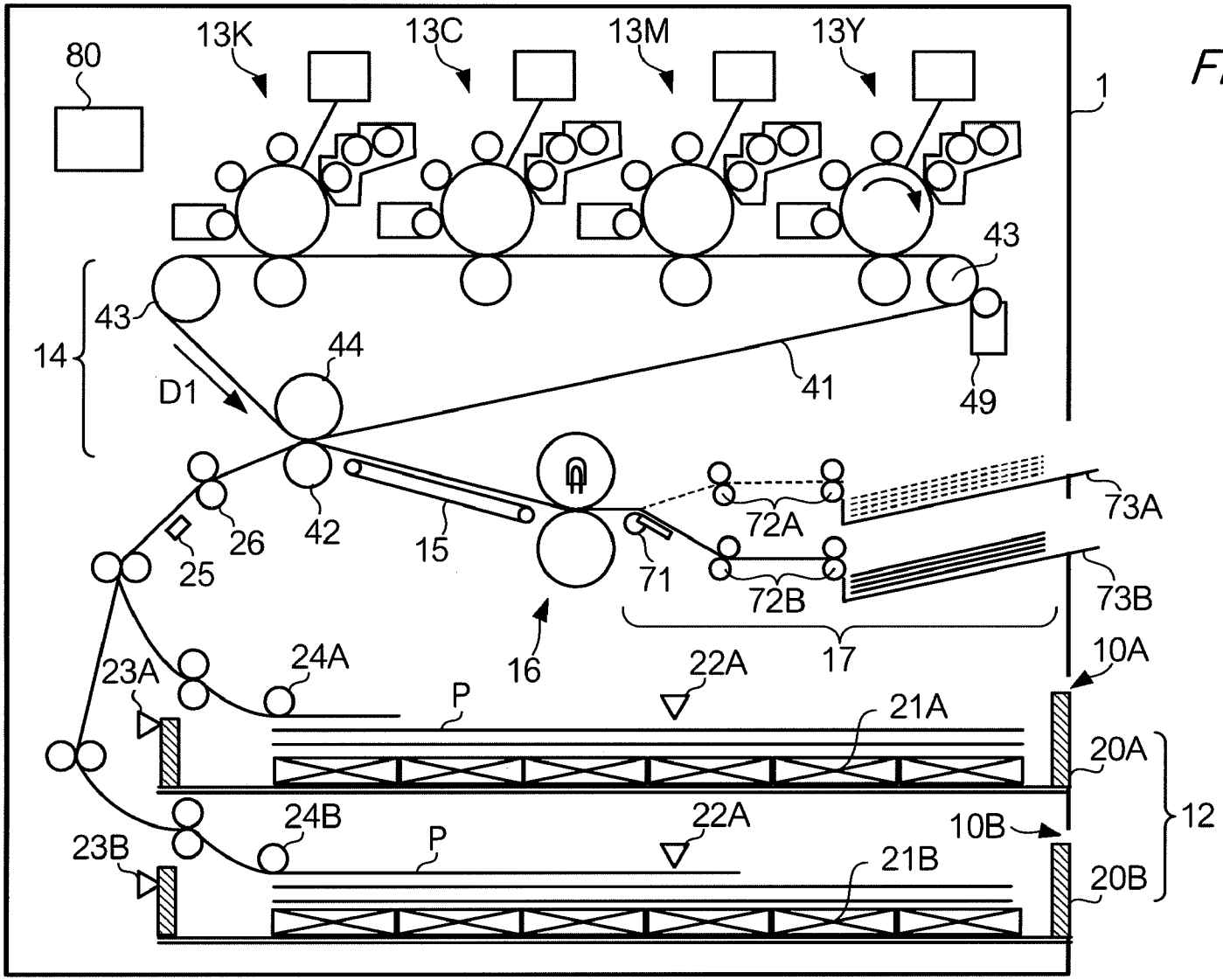
FIG. 1 is a diagram showing the entire configuration of an image-forming device related to the present exemplary embodiment.

FIG. 1 is a diagram showing the overall configuration of an image-forming device 1 related to the present exemplary embodiment. As shown in the FIG. 1, the image-forming device 1 includes a recording-medium-supplying section 12, image-forming units 13Y, 13M, 13C, 13K (hereinafter, these are collectively referred to as "the image-forming unit 13" if it is not necessary to specifically distinguish them), a transferring unit 14, a conveying device 15, a fixing section 16, a switching device 17, and a control section 80. The configuration of each of these is controlled by the control section 80. The control section 80 includes a CPU (Central Processing Unit) and a memory device such as ROM (Read Only Memory) and EEPROM (Electrically Erasable Programmable Read Only Memory). The CPU loads a program stored in the memory device into RAM (Random Access Memory) for execution, thereby controlling the image-forming device 1 in its entirety. Note that symbols Y, M, C, and K respectively represent configurations corresponding to yellow, magenta, cyan, and black toners.

The recording-medium-supplying section 12 houses paper that has been cut to a predefined size such as JIS (Japanese Industrial Standards) A3 and A4. The paper housed in the recording-medium-supplying section 12 is extracted one by one according to instructions from the control section 80, and is conveyed to the transferring unit 14 via a paper-conveying path. The transferring unit 14 forms an image on the paper as instructed by the control section 80. In other words, the paper is an example of recording media on which an image is to be formed. Furthermore, the recording media are not limited to paper and may be any sheet composed of resin, for example. The conveying device 15 is set at a position downstream from the position where the paper receives an image transferred from the intermediate transfer belt 41 in the transferring unit 14 and upstream from a fixing section 16, and inserts the paper onto which the image has been transferred by the transferring unit 14 into a fixing section 16. The fixing section 16 includes a heating roller and a supporting roller, and fixes the image transferred onto the paper. A switching device 17 switches the paper-conveying path after a fixing section 16. This constitutes the main configuration of the image-forming device 1.

A-2. Configuration of the Recording-Medium-Supplying Section]

Details of the recording-medium-supplying section 12 are described using FIGS. 1 and 2. In the following description, symbols A and B represent the respective components set at two different locations on the image-forming device 1, and they are omitted if it is not necessary to specifically distinguish these. As shown in FIG. 1, two insertion slots 10A and 10B that are open toward the right side in the figure have been set in the image-forming device 1. Paper cases 20A and 20B have respectively been inserted into these insertion slots 10A and 10B.

Figure 2A:
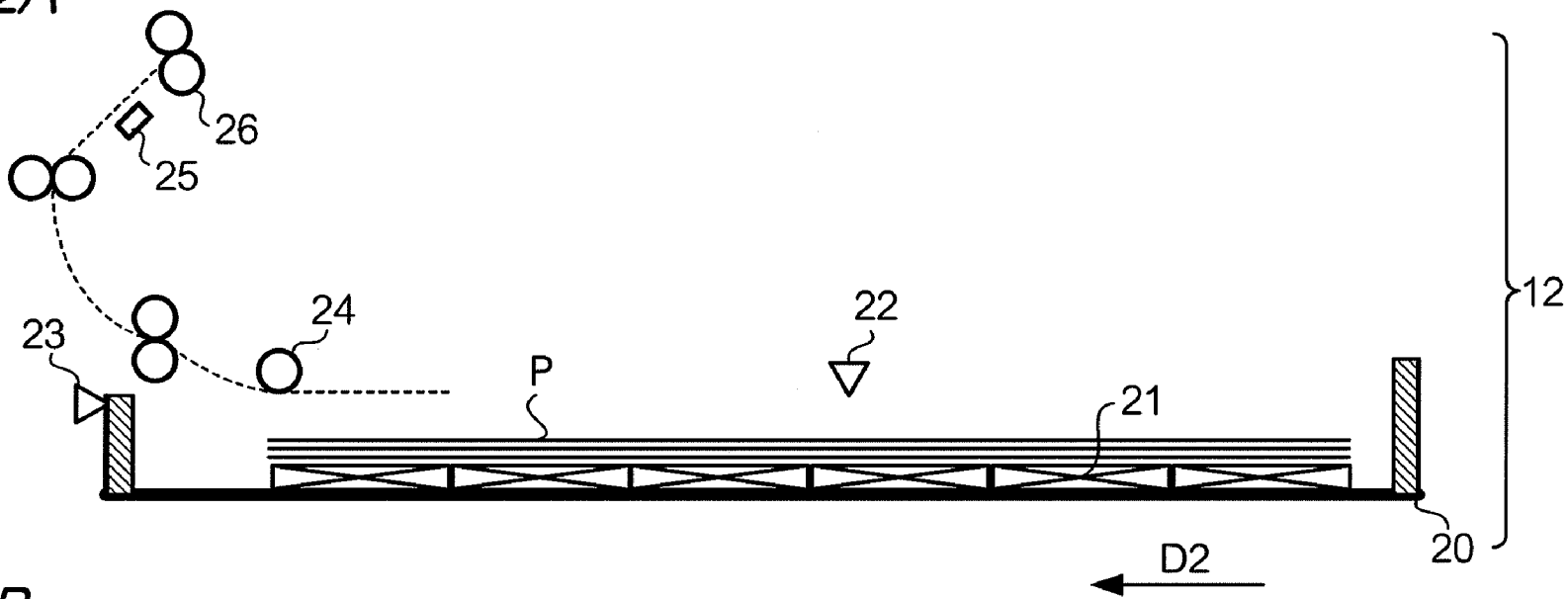
FIGS. 2A and 2B are diagrams for describing a paper case in a recording-medium-supplying section.
Figure 2B:
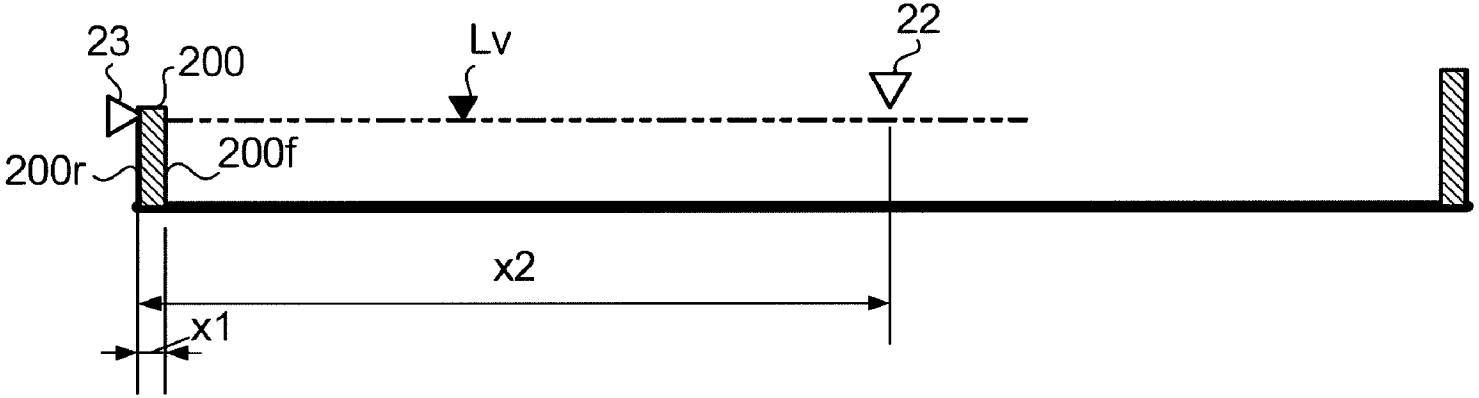

FIGS. 2A and 2B are diagrams for a describing the paper case 20 in the recording-medium-supplying section. A paper case 20 has a front plate set on the right side in the figure, a back plate 200 set on the left side in the figure, a bottom plate coupling lower ends of these to each other, and a side plate (not shown), whereby it forms a box-like container with these combined, and the ceiling thereof constitutes an opening. As shown in FIG. 2A, the paper case 20 has been inserted in the direction of arrow D2. A paper P is housed in the paper case 20 and the paper P is extracted one sheet at a time by the paper-pickup roller 24 and is conveyed to the transferring unit 14 via a group of rollers constituting the paper-conveying path through the conveyance path indicated by a dashed line in FIG. 2.

A level sensor 22 is a sensor that measures the top height of the paper stacked within the paper case 20. The level sensor 22 is secured at a predefined position in the image-forming device 1 and detects whether the paper P is at a position opposing the level sensor 22. Herein, a reflective sensor is used as the level sensor 22. Specifically, for example, the level sensor 22 may irradiate electromagnetic waves in pulses onto the top of the paper at predefined intervals, receive reflective waves, and measure the distance between the level sensor 22 and the surface of the paper P based on the time that has elapsed from the time of irradiation until the time of the receipt thereof. Furthermore, infrared rays or visible light rays may be utilized as electromagnetic waves, and ultrasound may also be used instead of electromagnetic waves. The level sensor 22 is configured so as to output an "ON signal" if the top height of the paper exceeds position Lv shown in FIG. 2 (*b*), and to not output the "ON signal" if it does not exceed that position. In other words, the "ON signal" output by the level sensor 22 is a signal indicating that an object is present at a position higher than position Lv. A lift 21 is an elevating device that is equipped at the bottom of the paper case 20 and is configured so as to be upwardly extendable. The paper P is stacked on the lift 21. Then, according to control via the control section 80 that has received the signal output from the level sensor 22, the lift 21 raises the paper P so that the surface position of the paper P at the top will be at position Lv.

A paper-case-detecting sensor 23 is a sensor that detects that the paper case 20 is at a predetermined position. For example, the paper-case-detecting sensor 23 may have two electrode contacts that are spaced apart from each other by being biased, and when external force resisting that biasing force is applied, the electrical contacts would contact each other and turn on the electricity, and thereby, the aforementioned detection can be performed. When the paper case 20 is inserted in the direction of arrow D2 as shown in FIG. 2A, the rear face 200*r* of the back plate 200 on the paper case 20 impacts and presses the paper-case-detecting sensor 23, and thus, the paper-case-detecting sensor 23 outputs an "ON signal". Moreover, the width of the back plate 200 on the paper case 20 in the direction of arrow D2 is designated as x1, and the distance between the level sensor 22 and the paper-case-detecting sensor 23 is designated as x2.

Register roller 26 is a roller that carries the paper P to the transferring unit 14. A paper sensor 25 is a sensor that detects that the paper P has been conveyed to register roller 26. For example, the paper sensor 25 may be an optical sensor, wherein light that irradiates from the light source equipped at an opposing position toward the conveyance path is blocked, thereby detecting that the paper P is on this conveyance path. The paper sensor 25 outputs an "ON signal" when it detects that the paper P is on the conveyance path.

A-3. Configuration of the Image-Forming Unit

The image-forming units 13Y, 13M, 13C, 13K as shown in FIG. 1 variously form an image according to image data, using corresponding color toners, and superimpose it on the intermediate transfer belt 41 to be transferred. This image data may be such that an original data has been read by an image-reading device (not shown) and may be generated based on data sent from a computer device (not shown). The image-forming units 13Y, 13M, 13C, 13K each differ only with respect to the toner that is used and have no significant differences in configuration. Hereinafter, if it is not necessary to specifically distinguish these, the suffix letters indicating the color of the toner are omitted and "the image-forming unit 13" is specified.

Figure 3:
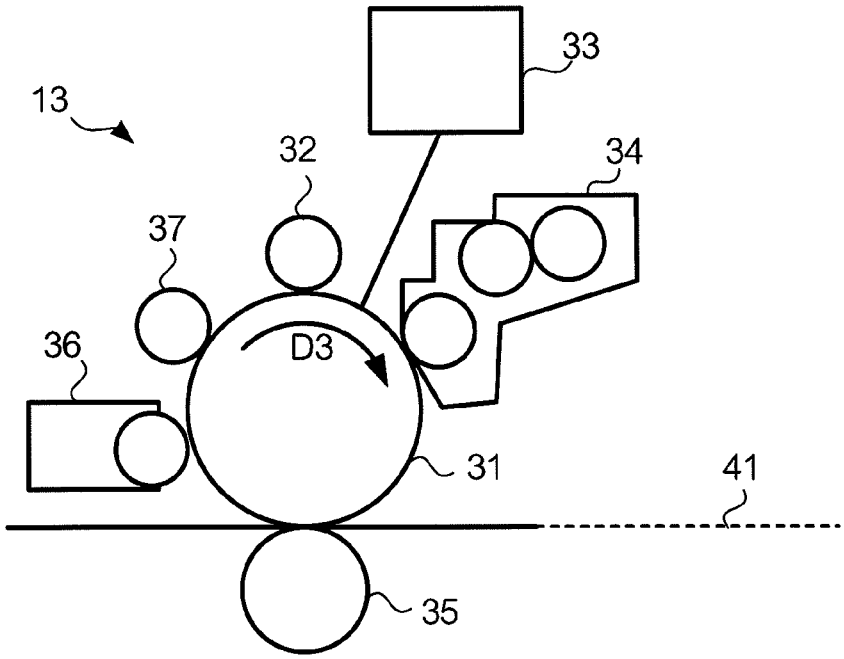
FIG. 3 is a diagram showing the configuration of an image-forming unit.

FIG. 3 is a diagram showing the configuration of the image-forming unit 13. As shown in FIG. 3, the image-forming unit 13 includes a photoreceptor drum 31, a roller charger 32, an exposure device 33, a developing equipment 34, a primary transferring roller 35, a drum cleaner 36, and the neutralization device 37. The photoreceptor drum 31 is an image retainer having charge-generating and charge-transporting layers, and is rotated in the direction of arrow D3 in the figure via a drive section (not shown). The roller charger 32 charges the surface of the photoreceptor drum 31. The exposure device 33 includes a laser emission source, a polygon mirror, and the like (none of which are shown), and via control by the control section 80, irradiates laser light corresponding to the image data onto the photoreceptor drum 31 after being charged by the roller charger 32. The developing equipment 34 houses the toner of any of colors Y, M, C, and K as well as a two-component developer including a magnetic carrier such as ferrite powder. Then, the tip of a magnetic brush formed in the developing equipment 34 contacts the surface of the photoreceptor drum 31, and thereby, the toner adheres to the portion on the surface of the photoreceptor drum 31 exposed by the exposure device 33, i.e., the line art of an electrostatic latent image, and an image is formed (developed) on the photoreceptor drum 31.

The primary transferring roller 35 produces a predefined potential difference at a position where the intermediate transfer belt 41 in the transferring unit 14 opposes the photoreceptor drum 31, and with this potential difference, it transfers an image to the intermediate transfer belt 41. The drum cleaner 36 removes the not transferred toner remaining on the surface of the photoreceptor drum 31 after transferring the image. The neutralization device 37 then neutralizes the surface of the photoreceptor drum 31. In other words, the drum cleaner 36 and the neutralization device 37 are for removing the unnecessary toner and charge from the photoreceptor drum 31 in preparation for the next image formation.

A-4. Configuration of the Transferring Unit

Referring to FIG. 1 again, the configuration of the transferring unit 14 will be described. The transferring unit 14 is a transferring unit that transfers an image formed by the image-forming units 13Y, 13M, 13C, 13K onto a paper, including the intermediate transfer belt 41, a secondary transferring roller 42, a belt-carrying roller 43, and a reverse roller 44. The intermediate transfer belt 41 is a belt member without ends, and the belt-carrying roller 43 and the reverse roller 44 tautly span the intermediate transfer belt 41. At least one of either the belt-carrying roller 43 or the reverse roller 44 includes a drive section (not shown) that moves the intermediate transfer belt 41 in the direction of arrow D1. Furthermore, the belt-carrying roller 43 or the reverse roller 44 without the drive section rotates according to the movement of the intermediate transfer belt 41. The intermediate transfer belt 41 moves in the direction of arrow D1 in the figure and subsequently rotates, and thereby, the image transferred by the transferring unit 14 is moved to a nip region formed by the secondary transferring roller 42 and the reverse roller 44. With a potential difference from the intermediate transfer belt 41, the secondary transferring roller 42 transfers the image on the intermediate transfer belt 41 onto the paper conveyed from the recording-medium-supplying section 12. The belt cleaner 49 then removes the not transferred toner remaining on the surface of the intermediate transfer belt 41.

A-5. Configuration of the Switching Device

The paper P that has been ejected from the transferring unit 14 and has passed through the conveying device 15 and a fixing section 16 is supplied to a switching device 17. A switching device 17 sorts the paper P into any of the ejecting destinations at two locations via control by the control section 80. In other words, depending on the angle of guide 71 controlled by the control section 80, the paper P passing through guide 71 is guided to either one of rollers 72A or 72B. Then, the paper P conveyed by the roller 72A is fed through an ejection section 73A, and the paper P conveyed by roller 72B is fed through an ejection section 73B, respectively. Herein, the ejection section 73B is an ejection section that ejects paper onto which an image has been normally formed, and the ejection section 73A is an ejection section that ejects paper other than that (for example, miscopied paper).

B. Operation

B-1. Operation of the Recording-Medium-Supplying Section

Figure 4A:
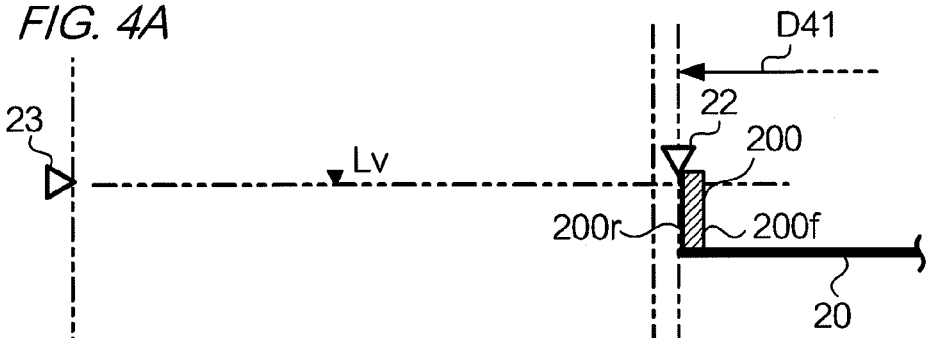
FIGS. 4A-4C are diagrams showing the status of insertion of a paper case in the recording-medium-supplying section.
Figure 4B:
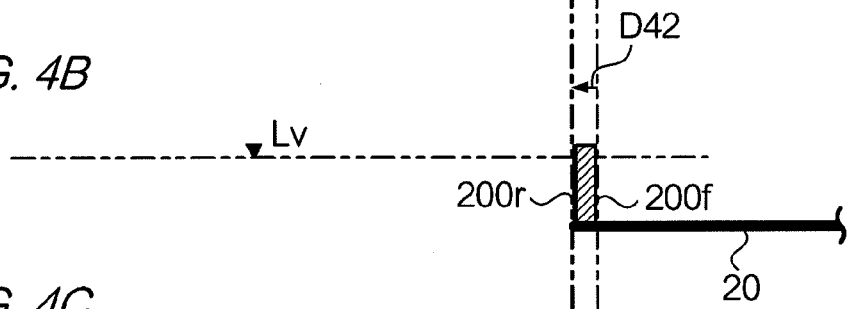
Figure 4C:
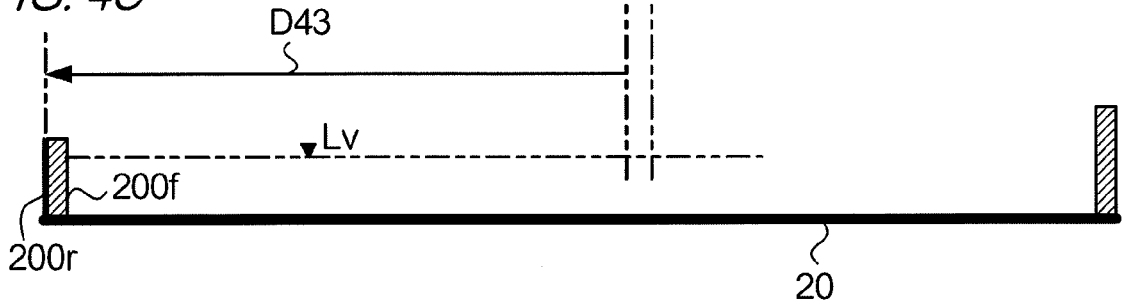

FIGS. 4A-4C are diagrams showing the status of insertion of the paper case 20 in the recording-medium-supplying section. The paper case 20 has been inserted through insertion slot 10 (not shown in FIGS. 4A-4C) and is moved in the direction of arrow D41 as shown in FIG. 4A. As shown in FIG. 4A, when the rear face 200*r* of the back plate 200 on the paper case 20 reaches the level sensor 22, the level sensor 22 outputs an "ON signal" indicating that an object is present at a position higher than position Lv. Then, as shown in FIG. 4B, when the paper case 20 moves in the direction of arrow D42 and front face 200*f* of the back plate 200 passes by the level sensor 22, the level sensor 22 no longer outputs the "ON signal". Note that, in a case in which the paper case 20 is at any position in FIGS. 4A and 4B, the back plate 200 of the paper case 20 has not been detected by the paper-case-detecting sensor 23, so the paper-case-detecting sensor 23 does not output the "ON signal". As shown in FIG. 4 (*c*), when the paper case 20 moves in the direction of arrow D43 and the rear face 200*r* of the back plate 200 contacts the paper-case-detecting sensor 23, the paper-case-detecting sensor 23 outputs an "ON signal".

B-2. Operation of the Noise Filter

Figure 5:
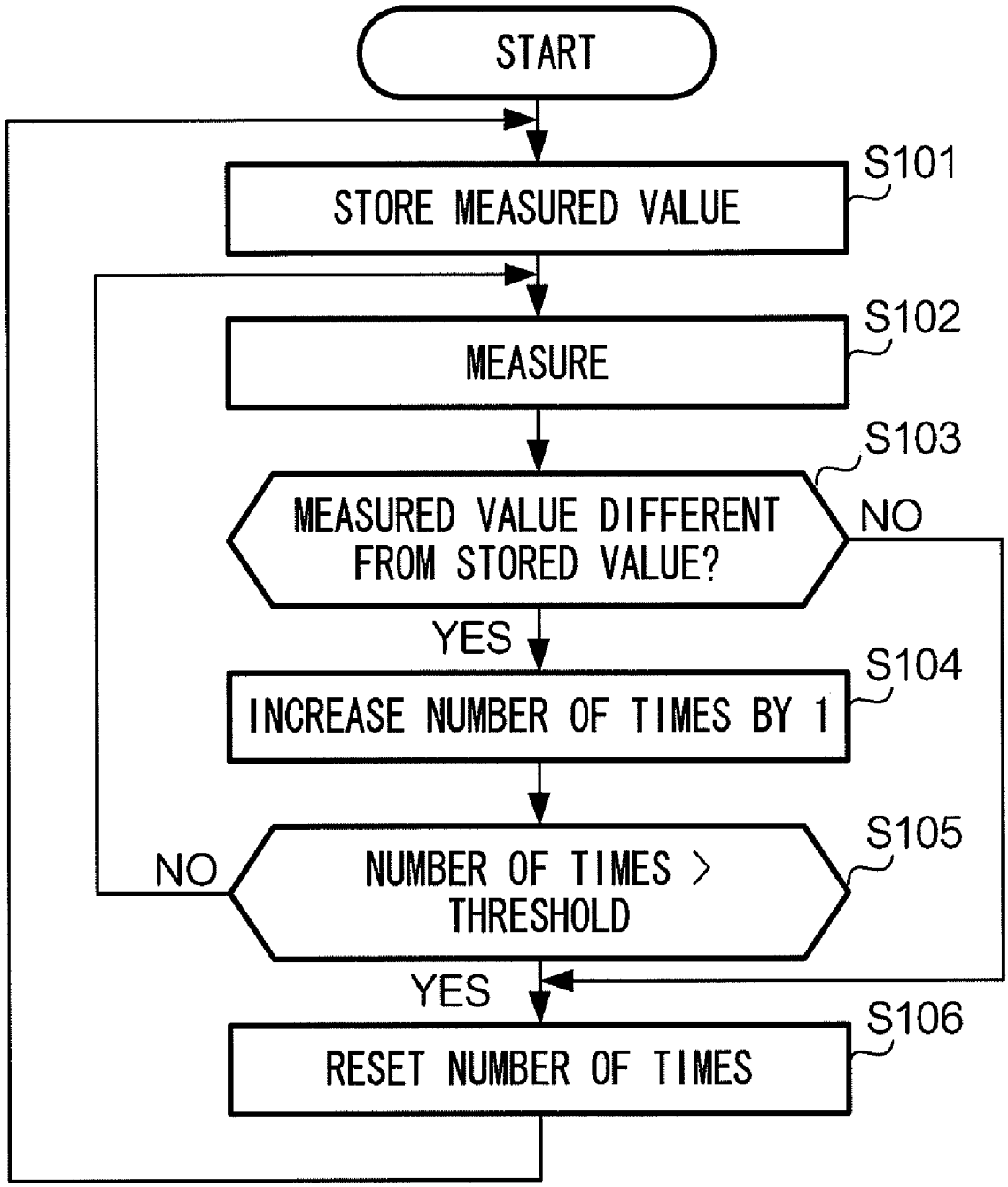
FIG. 5 is a flow chart showing the operation of a noise-filtering process.

Both the level sensor 22 and the paper-case-detecting sensor 23 detect the paper case 20 at intermittent intervals of approximately 100 milliseconds. Because these sensors may be subject to noise and consequently output an incorrect detection result, a noise-filtering process described below is implemented. FIG. 5 is a flow chart showing the operation of this noise-filtering process. First, the control section 80 stores a measured value received from the aforementioned sensor in the RAM as a stored value (step S101). Then, when an interrupt signal is received at intervals of approximately 100 milliseconds based on the clock of the timer, the control section 80 newly receives a measurement signal from the sensor (step S102) and determines whether that measured value is different from the stored value stored in the RAM (step S103). For example, if the stored value stored in the RAM is "ON", indicating an "ON signal", and the newly received measured value is "OFF", indicating a signal other than the "ON signal" (step S103; YES), the control section 80 proceeds with the process at step S104. In step S104, the control section 80 increases the "number of times" incrementally by 1 as a parameter to be stored in the RAM (step S104). This "number of times" is a parameter indicating the number of times in which the stored value stored in the RAM and the newly received measured value differ, wherein "0" is set in the initial state.

Next, the control section 80 compares the "number of times" stored in the RAM to a "threshold" predefined by a program being executed (step S105). Thus, if the "number of times" is not above the "threshold" (step S105; NO), the control section 80 resumes the process at step S102. Alternatively, if the "number of times" is above the "threshold" (step S105; YES), the control section 80 proceeds with the process at step S106. In step S106, the control section 80 resets the "number of times", i.e., sets the "number of times" to "0" (step S106), and resumes the process at step S101. On the other hand, in step S103, if it is determined that the measured value received in step S102 does not differ from the stored value stored in the RAM, i.e., it is the same (step S103; NO), the control section 80 proceeds with the process at step S106 without implementing steps S104 and S105. For example, if the "threshold" is "5", in step S102 of comparing the measured value to the stored value, a comparison is made after waiting for 100 milliseconds to elapse, so 100 milliseconds elapse five times while the measured value is from "0" to "5". Specifically, in this case, 5×100=500 milliseconds elapsing between the first change of the initial value and changing of the stored value.

Figure 6:
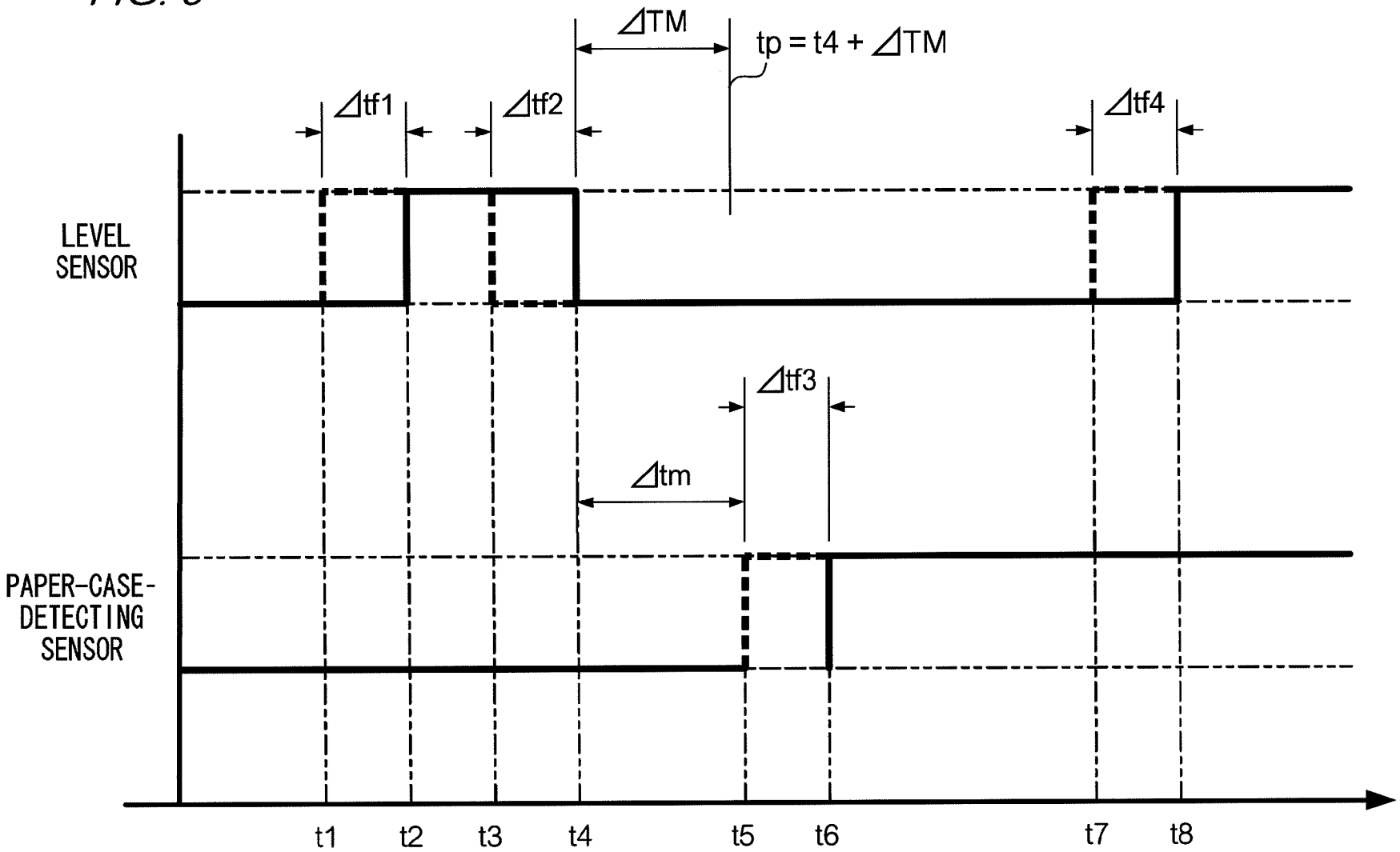
FIG. 6 is a diagram showing a temporary change in the respective values measured by a level sensor and a paper-case-detecting sensor.

FIG. 6 is a diagram showing a temporary change in the measured and stored values of the level sensor 22 and the paper-case-detecting sensor 23. In this figure, the transverse axis represents the time, and the right hand of the figure indicates the course of time. Dashed lines indicate the values measured by each sensor, and solid lines indicate the stored values. For each line, upper lines represent "ON" and lower lines represent "OFF". For example, at time instant t1, for the paper-case-detecting sensor 23, both the measured and stored values are "OFF", and for the level sensor 22, the stored value is "OFF" and the measured value is "ON". In other words, at time instant t1, the paper case 20 is at the position shown in FIG. 4A, that is, the position where the rear face 200*r* of the back plate 200 on the paper case 20 reaches the level sensor 22. Herein, for the level sensor 22, n1 has been predefined as the threshold, wherein measurements are taken n1 times after the measured value first becomes "ON", and when all of the measured values are "ON", the stored value becomes "ON". The time instant at which this stored value is rewritten as "ON" is t2 as shown in the figure. Herein, because the measurement interval of the level sensor 22 is approximately 100 milliseconds as described above, time Δtf1 between time instants t1 and t2 constitutes n1×100 milliseconds. Thus, because the same measured value sequentially repeats, the control section 80 verifies the measured values of these sensors and rewrites the stored values, so an inaccurate variation in the measured values caused by noise can be eliminated.

Herein, at time instant t3, the paper case 20 is at the position shown in FIG. 4B, that is, the position wherein front face 200*f* of the back plate 200 passes by the level sensor 22, followed by time instant t4 at which both measured values become "OFF". Then, an instant at which the value measured by the paper-case-detecting sensor 23 becomes "ON" is time instant t5. This is an instant at which the rear face 200*r* of the back plate 200 on the paper case 20 impacts and presses the paper-case-detecting sensor 23, and when the momentum of the paper case 20 is considerable, the image-forming device 1 is subject to vibration. Time elapsed Δtm between time instants t4 and t5 depends on the speed at which the paper case 20 is inserted, but by conducting an experiment in advance in order to set the mean value of the actual measurement values, for example, ΔTM is determined as the standard value of Δtm.

B-3. Operation of the Control Predicting Vibration

Figure 7:
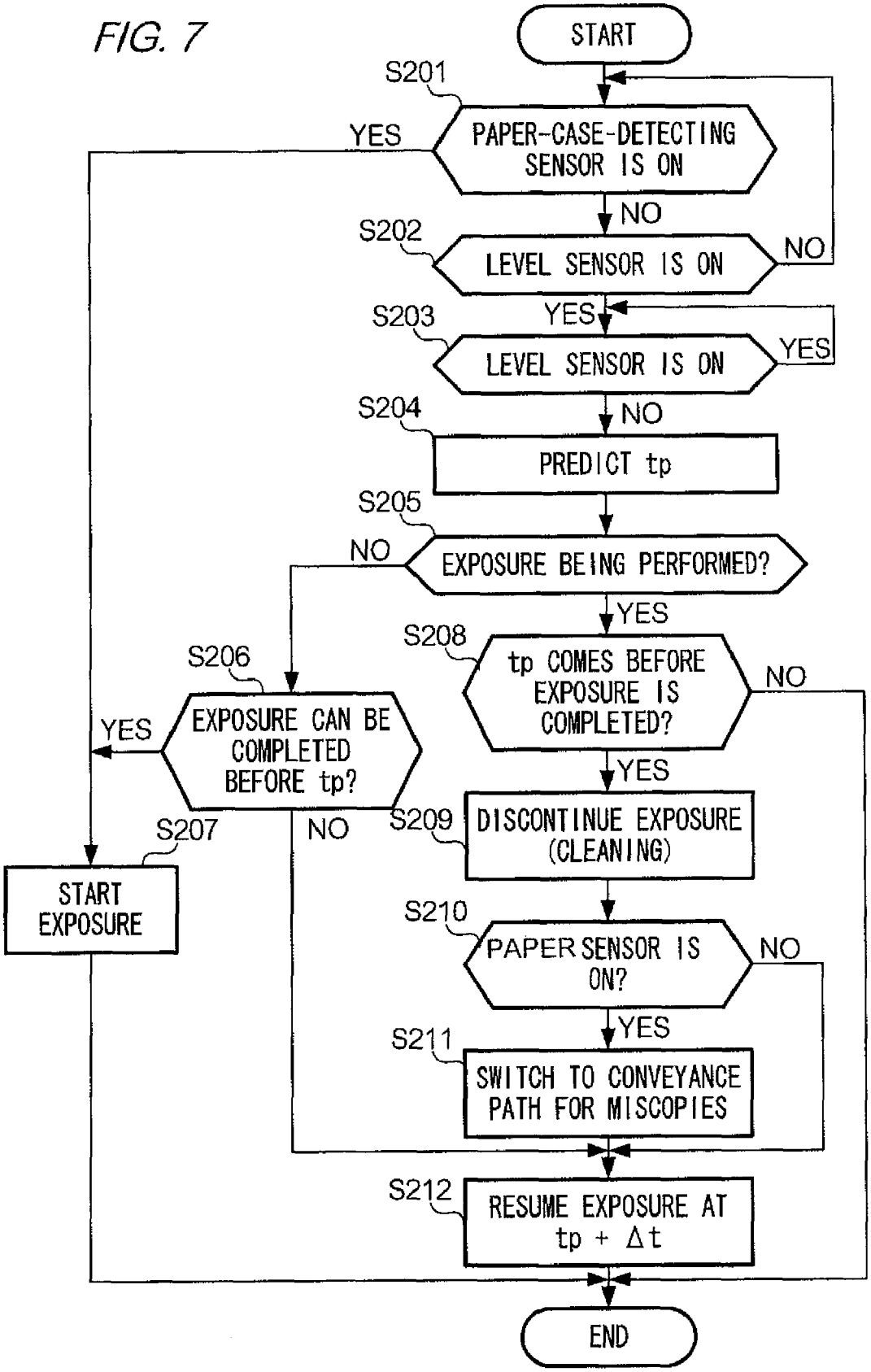
FIG. 7 is a flow chart showing the operation of controlling the prediction of vibration in an image-forming device via a control section.

FIG. 7 is a flow chart showing the operation of the control predicting vibration of the image-forming device 1 via the control section 80. The control section 80 determines whether the stored value of the paper-case-detecting sensor 23 is ON (step S201), and if it determines that it is ON (step S201; YES), it proceeds with the process at step S207 to initiate the exposure process. On the other hand, if it determines that the stored value of the paper-case-detecting sensor 23 is not ON (step S201; NO), it determines whether the stored value of the level sensor 22 is ON (step S202). When the control section 80 determines in step S202 that the stored value of the level sensor 22 is not ON (step S202; NO), it resumes the process at step S201. On the other hand, when it is determined that the stored value of the level sensor 22 is ON (step S202; YES), the control section 80 further determines whether the stored value of the level sensor 22 is ON (step S203) and repeats this determination while determining whether the stored value of the level sensor 22 is ON (step S203; YES). Then, in step S203, when it is determined that the level sensor 22 is no longer ON (step S203; NO), the control section 80 thereby determines that the paper case 20 has been inserted into insertion slot 10. In other words, the level sensor 22 is an example of detection units that detect that a housing unit housing a recording medium has been inserted into an insertion slot for accommodating the housing unit. Then, the control section 80 predicts vibratory excitation prediction time tp, a time instant at which the image-forming device 1 is likely to be subjected to vibration based on that time instant (step S204). This vibratory excitation prediction time tp is a time instant that is derived by adding ΔTM, which is the standard value of elapsed time Δtm described above (e.g., the mean of 1,000 actual measurement values), to time instant t4. In other words, the control section 80 constitutes an example of prediction units that predict a vibratory excitation time at which vibrations may occur based on the time detected by the level sensor 22, and vibratory excitation prediction time tp is described according to the following expression.

$$tp = t4 + \Delta TM$$

When predicting vibratory excitation prediction time tp, the control section 80 determines whether the image-forming unit 13 is performing the exposure process (step S205). When it determines that the image-forming unit 13 is not performing the exposure process (step S205; NO), the control section 80 determines whether the next exposure process can be completed before the vibrations will occur based on the vibratory excitation prediction time tp predicted at step S204 (step S206). In controlling the image-forming unit 13, the control section 80 generates a synchronizing signal, referred to as pacing, every time it performs an image-forming process for each page, and also, information regarding the time required for the exposure process for each page has been stored in advance in the ROM. Therefore, specifically, the control section 80 calculates the time instant at which the exposure process is completed based on the time instant at which this synchronizing signal is generated and the information regarding the time required for the exposure process to make a determination for step S206. If it is determined that the exposure process can be completed before vibratory excitation prediction time tp (step S206; YES), the control section 80 initiates the exposure process (step S207). On the other hand, if it determines that the exposure process cannot be completed before vibratory excitation prediction time tp (step S206; NO), it proceeds with the process at step S212 in order to delay the exposure process. In other words, the control section 80 constitutes an example of control units that control the image-forming unit in order to prevent image formation if it is determined that the vibration will occur during a period when the image-forming unit is forming an image on the recording medium.

In step S205, when it is determined that the image-forming unit 13 is performing the exposure process (step S205; YES), the control section 80 determines whether the vibrations will occur based on the vibratory excitation prediction time tp before the exposure process is completed (step S208). As with the determination in step S206, this determination is also made by calculating the time instant at which the exposure process is completed based on the aforementioned synchronizing signal and the like. Then, if it is determined that the vibrations will not occur based on the vibratory excitation prediction time tp until the exposure process is completed (step S208; NO), the control section 80 finishes this control of predicting vibration. Thereby, the exposure process that is designated to be performed in step S205 will be continued, and after the transferring process and the like, an image is formed on paper supplied from a paper supply source (e.g., another the paper case 20) different from the paper case 20 as detected by the level sensor 22.

On the other hand, if it is determined that the vibrations will occur based on the vibratory excitation prediction time tp before the exposure process is completed (step S208; YES), the control section 80 discontinues the exposure process and cleans the surface of the photoreceptor drum 31 with the drum cleaner 36 and the neutralization device 37 and also cleans the surface of the intermediate transfer belt 41 with the belt cleaner 49 (step S209). Next, the control section 80 determines whether the paper sensor 25 is outputting an "ON signal" (step S210), and if it determines that the "ON signal" is being output (step S210; YES), it allows guide 71 of a switching device 17 to be operated so as to guide paper to the ejection section 73A, an ejection section for miscopies, returns guide 71 after the paper for one page is guided to the ejection 73A (step S211), and proceeds with the process at step S212. Thereby, miscopies will be ejected via a mode different from that for a normal copy. In other words, the control section 80 constitutes an example of control units that control an ejection unit that ejects the recording medium in order to provide the following: a mode for ejecting the recording medium on which an image has been formed if it is determined that the vibrations will occur based on the vibratory excitation time during a period when the image-forming unit is forming an image on the recording medium; and a different mode for ejecting the recording medium on which an image has been formed if it is determined by the determination unit that the vibrations will not occur based on the vibratory excitation time during the same period.

On the other hand, when it is determined that the paper sensor 25 is not outputting the "ON signal" (step S210; NO), the control section 80 proceeds with the process directly at step S212. In step S212, the control section 80 resumes the exposure process at a time instant of vibratory excitation prediction time tp that is predicted in step S204 plus predefined waiting time Δt. This delays the time for performing the exposure process until that time instant (tp+Δt). In other words, the control section 80 constitutes an example of control units that delay the time at which the image-forming unit forms an image until a predefined period after the predicted vibratory excitation time has elapsed.

With the aforementioned operation, the image-forming device 1 detects the operation whereby the paper case 20 housing paper in the recording-medium-supplying section 12 is inserted into the image-forming device 1, predicts a time instant at which the image-forming device 1 will be subject to vibration due to this operation, and suppresses the effects of vibratory excitation on image formation by delaying the next exposure process beyond the prediction time instant if the exposure process is not being performed at that time instant, by discontinuing the exposure process if the exposure process is already being performed, and moreover, by sorting paper to be distinguished from other paper if an image has already been formed on this paper by the exposure process.

C. Modifications

The aforementioned exemplary embodiment may be modified as in the following examples. These modifications may also be combined.

(1) In the aforementioned exemplary embodiment, the process that is delayed according to predicted vibratory excitation prediction time tp is the exposure process, but in a case in which the image-forming device 1 includes an optical reader such as a scanner, the image-reading process may be delayed according to predicted vibratory excitation prediction time tp. In other words, when implementing a process that is susceptible to vibration, if it is predicted that vibration will occur while that process is being performed, it may be possible to suppress the effect of the vibration by delaying that process or by sorting the recording medium obtained from that process so as to make it identifiable. Furthermore, besides the aforementioned process of reading an image with a scanner, processes that are susceptible to vibration may include the process of acquiring an image with a camera (such as a digital still camera or a video camera), for example.

Moreover, vibration significantly affects optical mechanisms in particular, but this does not mean that they have no effect on development and transfer. Therefore, in a case such as the formation of a precise image, the image-forming device 1 may not perform an image-forming process if it is determined that the vibrations will occur based on the vibratory excitation time during developing or transfer. In other words, the control section 80 of the image-forming device 1 may not implement image formation if it is determined that the vibrations will occur based on the vibratory excitation time while an image is being formed on the paper.

(2) In the aforementioned exemplary embodiment, if it were to be predicted that the exposure process would be implemented at vibratory excitation prediction time tp or if it were actually performed, the exposure process would be discontinued in order to clean the image-forming unit 13 and the transferring unit 14, the exposure process by the image-forming unit 13 would be delayed, the paper on which an image had been formed would be sorted so as to be distinguishable from other paper, and other measures would be implemented, but the control section 80 may decide whether these processes should be performed depending on the type of image. For example, if the image is formed with a black toner only, if a mode for suppressing the toner usage is set, if the image is composed of text only, if the font size for that text is larger than a predefined size, and the like, the control section 80 may determine that there would be little effect on image formation from vibration and it may not operate guide 71. In this exemplary embodiment, the control section 80 may obtain information indicating the image type when performing image formation.

(3) In the aforementioned exemplary embodiment, a reflective sensor is utilized as the level sensor 22, but a transmissive sensor may also be used. Specifically, the level sensor 22 may irradiate light rays such as an infrared laser from one side of the paper case 20 at position Lv, detect this with a sensor situated on the other side, and generate an "ON signal" if the light rays are blocked. In addition, not only a single the level sensor 22 but also multiple sensors may be set. Furthermore, separately from the level sensor 22, a sensor may be installed that detects that the paper case 20 is being inserted via insertion slot 10. As in the aforementioned exemplary embodiment, allowing the level sensor 22 to combine functions for detecting the operation of inserting the paper case 20 would reduce the number of parts of the image-forming device 1.

(4) The paper-pickup roller 24 may also have function as the level sensor 22. In this case, the paper-pickup roller 24 is biased downward and its lower end is pressed downward below position Lv. Then, when the paper-pickup roller 24 is pressed upward by the paper surface or the back plate 200 of the paper case 20, two electrode contacts provided on the paper-pickup roller 24 make contact, and thereby, it may detect a resisting force against this biasing force and thus generate an "ON signal".

(5) Furthermore, in the aforementioned exemplary embodiment, the paper-case-detecting sensor 23 is a sensor that detects external force, but a sensor using electromagnetic waves or ultrasound may also be used. For such a sensor, either a reflective or transmissive sensor as described above may be used. In addition, not only one the paper-case-detecting sensor 23 but also multiple sensors may be set.

(6) In the aforementioned exemplary embodiment, paper cut into a predefined size such as JIS A3 and A4 is utilized as a recording material, but the recording material is not limited to paper and may be a sheet composed of resin, and an uncut roll of paper may be used.

(7) In the aforementioned exemplary embodiment, Y, M, C, and K toners are utilized, but a clear toner or a foamed toner may also be used. Furthermore, the image-forming device 1 does not need to form a colored image, and for example, it may be an image-forming device that uses black toner only.

(8) In the aforementioned exemplary embodiment, ΔTM is designated as the standard period of time elapsed Δtm from time instant t4 until time instant t5, and the control section 80 predicts vibratory excitation prediction time tp by adding time instant t4 to this ΔTM, but vibratory excitation prediction time tp may be predicted according to a time instant at which a measured value has changed. For example, the thickness of the back plate 200 on the paper case 20 may be x1. Moreover, at time instant t1, the rear face 200*r* on the back plate 200 is at a position reaching the level sensor 22, and at time instant t3, front face 200*f* of the back plate 200 is at a position passing by the level sensor 22. Therefore, mean moving velocity v of the paper case 20 from time instant t1 to time instant t3 is described using the following expression.

$$v=x1/(t3-t1)$$

Assuming that the paper case 20 has been inserted into the image-forming device 1 via uniform linear motion, between time instant t1 and an instant at which the rear face 200*r* of the back plate 200 impacts and presses the paper-case-detecting sensor 23 (i.e., vibratory excitation prediction time tp), the rear face 200*r* travels distance x2 between the level sensor 22 and the paper-case-detecting sensor 23, so vibratory excitation prediction time tp is described using the following expression.

$$tp=t1+x2/v$$

In other words, vibratory excitation prediction time tp may be predicted based on these expressions. In addition, movement of the paper case 20 may be presumed with movement models other than uniform linear motion. For example, vibratory excitation prediction time tp may be predicted by measuring the acceleration of the movement of the paper case 20 with multiple set level sensors 22 and assuming that the paper case 20 is following a uniform linear motion.

(9) In the aforementioned exemplary embodiment, in step S212, the control section 80 delays the time for implementing the exposure process by resuming the exposure process at an instant, which is vibratory excitation prediction time tp predicted in step S204 plus predefined waiting time Δt, but this delay time is not limited thereto. For example, the control section 80 may resume the exposure process at a certain instant, which is time instant t5, an instant at which the rear face 200*r* of the back plate 200 on the paper case 20 impacts and presses the paper-case-detecting sensor 23, plus predefined waiting time Δt. Thus, because the exposure process is resumed after a sufficient waiting time from the time instant at which vibration actually occurs, the effects of vibration on the exposure process can be reduced.

(10) In the aforementioned exemplary embodiment, in step S211, the control section 80 drives guide 71 of a switching device 17 so as to guide paper to the ejection section 73A, an ejection section for miscopies, but the control section 80 may implement any control to the extent that it controls the ejection unit that ejects the recording medium in order to provide the following: a mode for ejecting the recording medium on which an image has been formed if it is determined that the vibrations will occur based on the vibratory excitation time during a period when the image-forming unit is forming an image on the recording medium; and a different mode for ejecting the recording medium on which an image has been formed if it is determined by the determination unit that the vibrations will not occur based on the vibratory excitation time during the same period. For example, in step S211, the control section 80 may control the ejection device so as to rotate the paper to be ejected, to deviate it in a direction parallel to the paper surface and perpendicular to the ejecting direction, or to crease it, and then allow the ejection section to eject the same. Alternatively, it may be possible to identify miscopies or normal copies to be ejected.

(11) In the aforementioned exemplary embodiment, the control section 80 performs a noise-filtering process according to the flow shown in FIG. 5, but it is also possible to not implement a noise-filtering process. In such a case, a measured value is utilized as a stored value as-is. Furthermore, both the level sensor 22 and the paper-case-detecting sensor 23 perform the detection of the paper case 20 at intervals of 100 milliseconds, but this interval is not limited to 100 milliseconds. Moreover, these sensors may perform continuous detection rather than the periodic detection described above.

(12) Each program executed by the control section 80 of the image-forming device 1 can be provided as stored on magnetic recording media such as magnetic tape and magnetic disk, optical recording media such as an optical disc, magneto-optical recording media, and computer-readable recording media such as semiconductor memory. It is also possible to allow this program to be downloaded via a network such as the Internet. In addition, as for a control unit that performs such control, various devices can be applied; e.g., a dedicated processor or the like may be utilized.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A controller comprising:

a detection unit that detects that a housing unit housing a recording medium has been inserted into an insertion slot for inserting the housing unit;

a prediction unit that predicts a vibratory excitation time at which vibrations will occur based on a time detected by the detection unit;

a determination unit that determines whether the vibrations will occur based on the vibratory excitation time during a period when an image-forming unit is forming an image on a recording medium supplied from a different supply source for recording media from the housing unit inserted into the insertion slot; and a control unit that controls the image-forming unit to prevent image formation if the determination unit determines that the vibrations will occur during a period when the image-forming unit is forming an image on the recording medium.

2. The controller according to claim 1, wherein the control unit delays the time at which the image-forming unit forms the image until a predefined period from the vibratory excitation time predicted by the prediction unit has elapsed.

3. The controller according to claim 1, further comprising:

a memory that stores instructional information corresponding to individual image types indicating whether to implement control through the control unit, wherein the control unit is configured to specify the type of image formed by the image-forming unit and controls the image-forming unit to prevent image formation if the determination unit determines that the vibrations will occur during a period when the image-forming unit is forming an image on the recording medium and if the instructional information stored in the memory corresponding to the specified image type provides an instruction to implement control through the control unit.

4. A controller comprising:

a detection unit that detects that a housing unit housing a recording medium has been inserted into an insertion slot for inserting the housing unit;

a prediction unit that predicts a vibratory excitation time at which vibrations will occur based on a time detected by the detection unit;

a determination unit that determines whether the vibrations will occur based on vibratory excitation time during a period when an image-forming unit is forming an image on a recording medium supplied from a different supply source for recording media from the housing unit inserted into the insertion slot; and a control unit that controls an ejection unit that ejects the recording medium to provide: a mode for ejecting the recording medium on which an image has been formed if the determination unit determines that the vibratory excitation time will occur during a period when the image-forming unit is forming an image on the recording medium; and a different mode for ejecting the recording medium on which an image has been formed if the determination unit determines that the vibrations will not occur during the same period.

5. The controller according to claim 4, comprising:

a memory that stores instructional information corresponding to individual image types indicating whether to implement control through the control unit, wherein the control unit is configured to specify the type of image formed by the image-forming unit and controls the ejection unit that ejects the recording medium to provide: a mode for ejecting the recording medium on which an image has been formed if the determination unit determines that the vibrations will occur during a period when the image-forming unit is forming an image on the recording medium and the instructional information stored in the memory corresponding to the specified image type provides an instruction to implement control through the control unit; and a different mode for ejecting the recording medium on which an image has been formed if the determination unit determines that the vibrations will not occur during the same period.

6. An image-forming device comprising:

an image-forming unit that forms an image on a recording medium;

a detection unit that detects that a housing unit housing a recording medium has been inserted into an insertion slot for inserting the housing unit;

a prediction unit that predicts a vibratory excitation time at which vibrations will occur based on a time detected by the detection unit;

a determination unit that determines whether the vibrations will occur based on the vibratory excitation time during a period when the image-forming unit is forming an image on a recording medium supplied from a different supply source for recording media from the housing unit inserted into the insertion slot; and a control unit that controls the image-forming unit to prevent image formation if the determination unit determines that the vibrations will occur during a period when the image-forming unit is forming an image on the recording medium.

7. The image-forming device according to claim 6, wherein:

the image-forming unit includes an image retainer, a latent-image-forming unit that forms an electrostatic latent image on the surface of the image retainer, a developing unit that develops the latent image formed by the latent-image-forming unit, and a transferring unit that transfers the image developed by the developing unit to the recording medium; and the control unit allows the surface of the image retainer or the transferring unit to be cleaned by a cleaning unit if the determination unit determines that the vibrations will occur during a period when the image-forming unit is forming an image on the recording medium.

8. The image-forming device according to claim 7, wherein:

the image-forming unit includes:

a lifting unit that lifts the recording medium housed in the housing unit; and a level-detection unit that detects that an object at an opposed position is at a position higher than a threshold; wherein the level-detection unit functions as the detection unit that detects that the housing unit has been inserted into the insertion slot by detecting that the recording medium lifted by the lifting unit is at a position higher than the threshold if the housing unit housing the recording medium has been inserted deep into the insertion slot, or, if the housing unit has not been inserted deep into the insertion slot, by detecting that the upper edge of the housing unit is at a position higher than the threshold.

9. The image-forming device according to claim 6, wherein:

the image-forming unit includes:

a lifting unit that lifts the recording medium housed in the housing unit; and a level-detection unit that detects that an object at an opposed position is at a position higher than a threshold; wherein the level-detection unit functions as the detection unit that detects that the housing unit has been inserted into the insertion slot by detecting that the recording medium lifted by the lifting unit is at a position higher than the threshold if the housing unit housing the recording medium has been inserted deep into the insertion slot, or, if the housing unit has not been inserted deep into the insertion slot, by detecting that the upper edge of the housing unit is at a position higher than the threshold.

10. An image-forming device comprising:

an image-forming unit that includes an image retainer, a latent-image-forming unit that forms an electrostatic latent image on the surface of the image retainer, a developing unit that develops the latent image formed by the latent-image-forming unit, a transferring unit that transfers the image developed by the developing unit to the recording medium, an ejection unit that ejects the recording medium to which the image has been transferred by the transferring unit to any of a plurality of ejection destinations, a carrying unit that carries the recording medium from the supply unit to the transferring unit, and a detection unit that detects the position of the recording medium conveyed by the carrying unit, and forms the image on the recording medium;

a detection unit that detects that a housing unit housing a recording medium has been inserted into an insertion slot for inserting the housing unit;

a prediction unit that predicts a vibratory excitation time at which vibrations will occur based on a time detected by the detection unit;

a determination unit that determines whether the vibrations will occur based on the vibratory excitation time during a period when the image-forming unit is forming an image on a recording medium supplied from a different supply source for recording media from the housing unit inserted into the insertion slot; and a control unit that controls the ejection unit that ejects the recording medium to provide: a mode for ejecting the recording medium on which an image has been formed if the determination unit determines that the vibrations will occur during a period when the image-forming unit is forming an image on the recording medium and if the recording medium detected by the detection unit is at a predefined position; and a different mode for ejecting the recording medium on which an image has been formed if the determination unit determines that the vibrations will not occur during the same period.

11. A computer readable storage medium storing a program for causing a computer to execute a process, the process comprising:

detecting that a housing unit housing a recording medium has been inserted into an insertion slot for inserting the housing unit;

predicting a vibratory excitation time at which vibrations will occur based on a time at which the insertion of the housing unit is detected;

determining whether the vibrations will occur based on the predicted vibratory excitation time during a period when an image-forming unit is forming an image on a recording medium supplied from a different supply source for recording media from the housing unit inserted into the insertion slot; and controlling the image-forming unit to prevent image formation if it is determined that the vibrations will occur during a period when the image-forming unit is forming an image on the recording medium.

12. A computer readable storage medium storing a program for causing a computer to execute a process, the process comprising:

detecting that a housing unit housing a recording medium has been inserted into an insertion slot for inserting the housing unit;

predicts a vibratory excitation time at which vibrations will occur based on a time at which the insertion of the housing unit is detected;

determining whether the vibrations will occur based on the predicted vibratory excitation time during a period when an image-forming unit is forming an image on a recording medium supplied from a different supply source for recording media from the housing unit inserted into the insertion slot; and controlling an ejection unit that ejects the recording medium to provide: a mode for ejecting the recording medium on which an image has been formed if it is determined that the vibrations will occur during a period when the image-forming unit is forming an image on the recording medium; and a different mode for ejecting the recording medium on which an image has been formed if it is determined that the vibrations will not occur during the same period.

* * * * *